United States Patent [19]

Foster

[11] Patent Number: 4,985,926

[45] Date of Patent: Jan. 15, 1991

[54] HIGH IMPEDANCE PIEZOELECTRIC TRANSDUCER

[75] Inventor: Richard G. Foster, Albuquerque, N. Mex.

[73] Assignee: Motorola, Inc., Schaumburg, Ill.

[21] Appl. No.: 161,877

[22] Filed: Feb. 29, 1988

[51] Int. Cl.[5] ..... H04R 17/00

[52] U.S. Cl. ..... 381/77; 381/190; 310/366; 310/369; 361/330; 367/155

[58] Field of Search ..... 381/77, 82, 190, 173, 381/116, 114; 310/311, 320, 321, 364, 366, 369, 316, 317, 331, 313 A; 367/155, 161, 163; 361/321 F, 271, 278, 303, 328, 330, 308

[56] References Cited

U.S. PATENT DOCUMENTS

| | | | |
|---|---|---|---|
| 3,093,775 | 6/1963 | Lamphier | 361/330 |
| 3,253,199 | 5/1966 | Cozens | 361/330 |
| 3,292,063 | 12/1966 | Kellerman | 361/330 |
| 3,493,825 | 2/1970 | Khouri | 361/321 F |
| 3,548,116 | 12/1970 | Schafft | 179/110 |
| 3,745,431 | 7/1973 | Imamura | 361/330 |
| 3,894,198 | 7/1975 | Murayma | 381/190 |
| 4,078,160 | 3/1978 | Bost | 179/110 |
| 4,389,548 | 6/1983 | Morikawa | 381/190 |
| 4,401,857 | 8/1983 | Morikawa | 381/190 |

*Primary Examiner*—Tommy P. Chin

*Attorney, Agent, or Firm*—Charles L. Warren

[57] ABSTRACT

An improved bimorph piezoelectric transducer provides higher input impedance and allows operation at higher operating voltages. First and second piezoelectric elements have opposing electrode patterns which define a plurality of capacitors connected in series. This allows such transducers to be directly connected to high voltage audio distribution systems without the need for an impedance matching circuit.

15 Claims, 1 Drawing Sheet

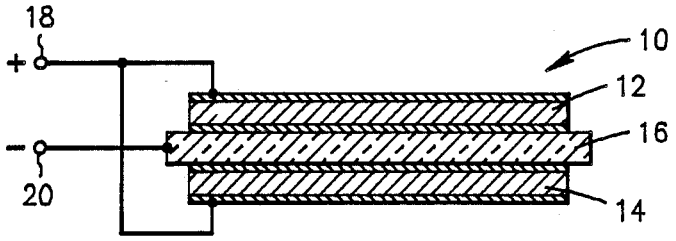
FIG. 1
—PRIOR ART—
Class 381
Sub. 77
FIG. 2
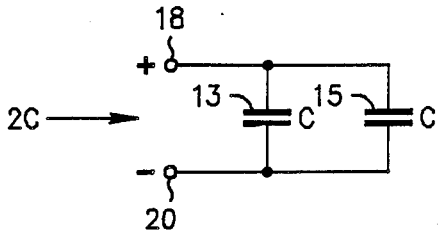
FIG. 3
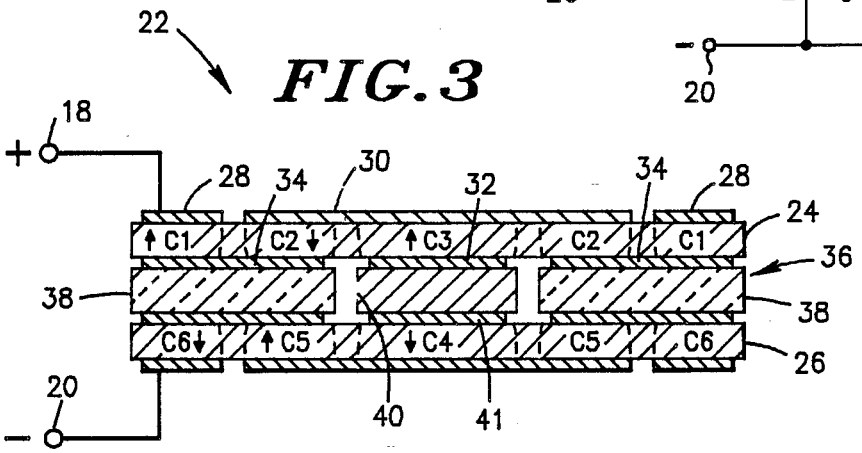
FIG. 4
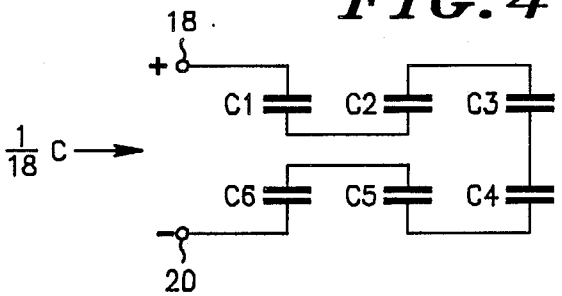
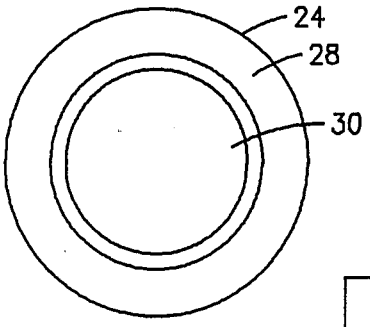
FIG. 5
FIG. 6
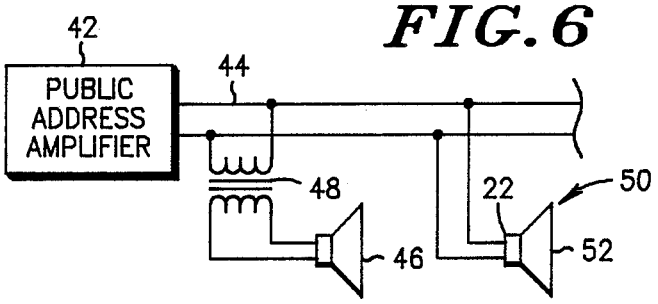

HIGH IMPEDANCE PIEZOELECTRIC TRANSDUCER

BACKGROUND

This invention relates to piezoelectric transducers and more specifically to such transducers which can provide a high input impedance by coupling a plurality of integral capacitors in series.

Conventional bimorph voice range piezoelectric speakers have an input impedance of less than 100 ohms at a frequency of 1500 Hertz (Hz). A typical 70.7 volt audio distribution system is designed to accept speakers having an impedance of 500 ohms to 10,000 ohms which corresponds to power levels of 10 watts to 0.5 watts, respectively. Thus, a matching circuit or transformer is required to couple a conventional piezoelectric speaker to such an audio system.

It is an object of this invention to provide a piezoelectric transducer having a higher input impedance which can be directly coupled to audio systems requiring such impedances. A further object of this invention is to provide a piezoelectric transducer capable of operating with sustained voltages greater than 20 volts.

BRIEF DESCRIPTION OF THE DRAWINGS

The same reference numerals in different figures represent like elements.

FIG. 1 illustrates a conventional bimorph piezoelectric driver.

FIG. 2 is a schematic of an equivalent circuit of the driver shown in FIG. 1.

FIG. 3 is cross-sectional view of an embodiment of a piezoelectric driver according to the present invention.

FIG. 4 is a schematic of an equivalent circuit of the driver shown in FIG. 3.

FIG. 5 is a top view of the driver shown in FIG. 3.

FIG. 6 is a diagram of a high impedance audio distribution system incorporating a piezoelectric transducer according to the present invention.

DETAILED DESCRIPTION

FIG. 1 shows a conventional bimorph driver 10 having piezoelectric elements 12 and 14. Both major surfaces of these elements have conductive electrodes. The adjacent electrodes of elements 12 and 14 are connected together by a center vane 16 which is preferably made of a conductive woven mesh such as described in U.S. Pat. No. 4,078,160. The outside electrodes are connected together by an external wire to the positive terminal 18 of the driving voltage source; the negative terminal 20 of the source is connected to the center vane 16 and hence to the inside electrodes on the elements.

FIG. 2 is a schematic of an equivalent circuit of the driver 10. Capacitors 13 and 15 represent the capacitance C of elements 12 and 14, respectively. As is apparent capacitors 13 and 15 are connected in parallel and provide an equivalent total circuit capacitance of 2C.

FIG. 3 illustrates a generally circular piezoelectric driver 22 according to the present invention which includes piezoelectric elements 24 and 26. The upper surface of element 24 has a center circular electrode area 30 surrounded by an annular spaced-apart electrode 28 as shown in FIG. 5. As used herein, "annular" means the continuous center electrode 30 as well as ring electrode 28. The lower surface of element 24 has a center circular electrode area 32 that is smaller than electrode 30 and an annular electrode 34 which is wider than electrode 28 so that it opposes the latter and also overlaps a portion of electrode 30. These opposing electrodes define capacitors C1, C2 and C3 which are connected in series as shown by the equivalent circuit in FIG. 4.

In the embodiment of driver 22 shown in FIG. 3, element 26 has the same electrode patterns as element 24. These elements are disposed so that adjacent surfaces have the same electrode patterns. Thus element 26 defines series connected capacitors C4, C5 and C6 which are equal in capacitance to capacitors C3, C2 and C1, respectively.

A center wafer 36 disposed contiguously between elements 24 and 26 consists of an nonconductive ring 38 and a spaced-apart center conductive portion 40. A conductive woven mesh such as described in U.S. Pat. No. 4,078,160 is suitable for portion 40. The same type of woven mesh except without being conductive is suitable for ring 38. The conductive portion 40 provides electrical connection between the electrodes 32 and 41 which connects capacitors C3 and C4 as shown in FIG. 4.

The driver 22 provides an equivalent capacitance of C/18 since the six series connected capacitors each have a capacitance of C/3. Because impedance is inversely proportional to capacitance, the impedance of driver 22 is eighteen times the impedance of a monomorph having a capacitance of C and thirty-six times the impedance of the bimorph driver 10. Thus a piezoelectric transducer according to the present invention can provide a higher input impedance than conventional bimorph and monomorph transducers.

The arrows in FIG. 3 between the electrodes defining the capacitor plates show the polarity of poling, i.e. the application of an initial voltage across the areas of the piezoelectric elements needed to ititalize it. This alternating polarity of poling is needed so that the alternating charges which will develop across each series capacitor will induce forces that each contribute to the same type of dimensional variation in each piezoelectric element. Of course, the dimensional variation in element 24 will be opposite that of element 26 to enhance the flexure of the transducer.

If it is desirable to maintain uniform poling along each piezoelectric element, separately formed capacitors without common electrodes on each element can be formed. In order to maintain the same polarity of capacitance charge relative to the poling polarity in series connected capacitors on a uniformly poled element, external wires or conductive feedthrough paths in the elements are needed to interconnect the bottom electrode in one capacitor to the top electrode in an adjacent capicator to form a daisy-chain of capacitors. The same electrical performance can be attained with uniformly poled elements but at the expense of more complex interconnections.

FIG. 6 shows an audio distribution system such as could be used in a large building for paging. A public address amplifier or audio source 42 typically drives an audio line 44 having an impedance of greater than 1000 ohms, such as 5000 ohms, with a relatively high voltage audio signal such as 70 volts. A conventional piezoelectric driven speaker 46 has a typical impedance of less than 100 ohms and cannot be directly connected since it cannot withstand the high operating voltages present on the audio line 44. A transformer 48 provides a voltage step down for speaker 46 thereby also providing an impedance match.

A speaker 50 having a piezoelectric driver 22 according to the present invention and a diaphragm 52 can be directly connected to line 44 since it has a compatible impedance and can operate at the higher voltages normally used in such audio distribution systems. By contrasting FIG. 4 with FIG. 2 it will be seen that the total audio voltage applied will be present across capacitors 13 and 15 while only 1/6 of the total voltage will appear across each of capacitors C1–C6. Thus the present invention eliminates the need for a matching circuit or transformer.

In the illustrative embodiment of the present invention electrode patterns were designed to form three capacitors on each piezoelectric element. It will be apparent to those skilled in the art that the present invention can employ two or more capacitors per element to achieve various impedance levels. Selecting an odd number of capacitors per element provides the advantage of allowing the capacitor formed in the center of the element to be internally connected to the opposing center formed capacitor. Thus the present invention contemplates N capacitors formed per piezoelectric element, where N is an integer greater than one and is preferably an odd integer.

Forming a bimorph driver with two such elements in which the capacitors on the elements are connected in series allows higher impedances and operating voltages to be achieved. The capacitors could also be designed to have unequal capacitances and could have shapes other than annular. Of course, only one piezoelectric element could be used as a monomorph.

Although an embodiment of the present invention has been described and shown in the drawings, the scope of the invention is defined by the claims which follow.

What is claimed is:

1. A transducer comprising:

a first piezoelectric element having first and second major surfaces;

a second piezoelectric element having third and fourth major surfaces;

means for forming at least two piezoelectric members having capacitance characteristics on each of said first and second piezoelectric elements so that all of said members on each of said elements are electrically in series; and means for connecting one of said members on said first element to one of said members on said second element to form an equivalent series electrical circuit, said members oriented to maximize physical deflection of said elements.

2. The transducer according to claim 1 wherein said forming means comprises at least two annular separated electrodes on each of said major surfaces of said first and second piezoelectric elements.

3. The transducer according to claim 2 wherein at least one of the annular electrodes on the second and third surfaces overlap portions of said two electrodes on the first and fourth surfaces, respectively.

4. The transducer according to claim 3 wherein said at least one annular electrode on the second surface is disposed opposite said at least one annular electrode on said third surface, and said connecting means comprises a wafer disposed contiguously between said second and third surfaces, said wafer being nonconductive except for a conductive portion between said at least one electrode on said second and third surfaces thereby providing a direct connection between said one capacitor on said first element and said one member on said second element.

5. The transducer according to claim 1 further comprising a diaphragm coupled to said transducer.

6. An audio distribution system comprising:

a source of audio signals for generating a predetermined audio voltage; and a plurality of piezoelectric audio transducers having a predetermined power handling rating connected in parallel to said source, each of said transducers comprising:

a first piezoelectric element having first and second major surfaces;

a second piezoelectric element having third and fourth major surfaces;

means for forming at least two piezoelectric members having capacitance characteristics on each of said first and second piezoelectric elements so that all of said members on each element are electrically in series; and means for connecting one of said members on said first element to one of said members on said second element to form an equivalent electrical circuit of said at least four members, in series having an input impedance sufficient to limit the power to the transducer to not greater than said predetermined power handling rating of said transducer, said members oriented to maximize physical deflection of said elements.

7. The system according to claim 6 wherein said forming means comprises at least two annular separated electrodes on each of said major surfaces of said first and second piezoelectric elements.

8. The system according to claim 7 wherein at least one of the annular electrodes on each of the second and third surfaces overlap portions of said two electrodes on the first and fourth surfaces, respectively.

9. The system according to claim 8 wherein said at least one annular electrode on the second surface is disposed opposite said at least one annular electrode on said third surface, and said connecting means comprises a wafer disposed continuously between said second and third surfaces, said wafer being nonconductive except for a conductive portion between said at least one annular electrode on said second and third surfaces thereby providing a direct connection between said one capacitor on said first element and said one member on said second element.

10. The system according to claim 6 further comprising a diaphragm coupled to each of said transducers.

11. A transducer comprising:

a first piezoelectric element having first and second major surfaces; and means for forming at least two piezoelectric members having capacitance characteristics on said first piezoelectric element so that all of said members on said element are electrically in series and all are oriented to maximize physical deflection of said element.

12. The transducer according to claim 11 wherein said forming means comprises at least two annular separated electrodes on each of said major surfaces of said first piezoelectric element.

13. The transducer according to claim 12 wherein at least one of the annular electrodes on the second surface overlaps portions of two electrodes on said first surface.

14. The transducer according to claim 11 further comprising a diaphragm coupled to said transducer.

15. The transducer according to claim 11 wherein said forming means comprises at least two separated electrodes on each of the major surfaces of said element.

* * * * *

UNITED STATES PATENT AND TRADEMARK OFFICE

CERTIFICATE OF CORRECTION

PATENT NO. : 4,985,926

DATED : January 15, 1991

INVENTOR(S) : Richard G. Foster

It is certified that error appears in the above-identified patent and that said Letters Patent is hereby corrected as shown below:

Claim 4, Column 3, line 68, "capacitor" should be --member--.

Claim 9, Column 4, lines 43 and 44, "capacitor" should be --member--.

Signed and Sealed this

Seventeenth Day of November, 1992

*Attest:*

DOUGLAS B. COMER

*Attesting Officer*

*Acting Commissioner of Patents and Trademarks*